US005903802A

United States Patent [19]

Watanabe et al.

[11] Patent Number: 5,903,802

[45] Date of Patent: May 11, 1999

[54] METHOD FOR FORMING AN IMAGE BY ABSORBING A RELEASE AGENT USING A RELEASE AGENT ABSORBING LAYER COATED ON FEED PASSAGE MEMBER

[75] Inventors: Akira Watanabe, Yokohama; Toru Obuchi, Kawasaki; Masahiro Itoh, Sagamihara; Takeo Tsunemi, Kawasaki; Takeshi Menjo, Tokyo; Yasuo Nami, Kawasaki; Kazuo Kishino; Hideo Kawamoto, both of Kawasaki; Jiro Ishizuka, Tokyo, all of Japan

[73] Assignee: Canon Kabushiki Kaisha, Tokyo, Japan

[21] Appl. No.: 08/794,768

[22] Filed: Feb. 3, 1997

Related U.S. Application Data

[63] Continuation of application No. 08/501,279, Jul. 17, 1995, abandoned, which is a continuation of application No. 07/968,686, Oct. 30, 1992, abandoned.

[30] Foreign Application Priority Data

Nov. 7, 1991 [JP] Japan ..... 3-318682
Jun. 29, 1992 [JP] Japan ..... 4-171220

[51] Int. Cl.[6] ..... G03G 15/20; G03G 21/00

[52] U.S. Cl. ..... 399/98; 399/303; 399/324

[58] Field of Search ..... 399/68, 98, 303, 399/324, 325

[56] References Cited

U.S. PATENT DOCUMENTS

| | | | |
|---|---|---|---|
| 4,257,699 | 3/1981 | Lentz | 355/284 |
| 4,810,564 | 3/1989 | Takahashi et al. | 428/213 |
| 5,049,944 | 9/1991 | De Bolt et al. | 355/284 |
| 5,086,318 | 2/1992 | Takeda et al. | 355/271 |
| 5,120,609 | 6/1992 | Blaszak et al. | 355/284 X |
| 5,132,737 | 7/1992 | Takeda et al. | 355/271 |
| 5,168,290 | 12/1992 | Tanaka et al. | 355/271 X |

FOREIGN PATENT DOCUMENTS

| | | | |
|---|---|---|---|
| 57-66459 | 4/1982 | Japan | 355/284 |
| 59-53872 | 3/1984 | Japan | 355/284 |
| 59-162085 | 9/1984 | Japan | 355/284 |
| 59-182462 | 10/1984 | Japan | 355/284 |
| 61-41153 | 2/1986 | Japan | 355/284 |
| 3-51871 | 3/1991 | Japan | 355/284 |

*Primary Examiner*—Fred L. Braun
*Attorney, Agent, or Firm*—Fitzpatrick, Cella, Harper & Scinto

[57] ABSTRACT

An image forming apparatus, such as a copying machine, has a fixing device for fixing a developer image transferred to a transfer medium, such as paper, with a fixing roller whose surface is coated with a release agent, such as oil, and includes at least one feed passage member for conveying, while contacting, a transfer medium to a transfer region of the apparatus. The feed passage member has a release agent absorbing layer on the surface thereof, and is thus advantageous for preventing release agent from being transferred and adhered to a photo-sensitive drum of the apparatus. The release agent absorbing layer of the feed passage member may contain either porous particles or particles and a binder resin, and be formed on another layer for retaining release agent absorbed by the release agent absorbing layer. The feed passage member preferably constitutes a transfer medium carrying member, which may include a dielectric sheet, for supporting and carrying a transfer medium. The member may alternatively constitute a pick-up roller, a feed guide, and/or a resist roller of the apparatus.

8 Claims, 7 Drawing Sheets

METHOD FOR FORMING AN IMAGE BY ABSORBING A RELEASE AGENT USING A RELEASE AGENT ABSORBING LAYER COATED ON FEED PASSAGE MEMBER

This application is a continuation of application Ser. No. 08/501,279 filed Jul. 17, 1995, now abandoned, which is continuation of application Ser. No. 07/968,686 filed Oct. 30, 1992, now abandoned.

BACKGROUND OF THE INVENTION

1. Field of the Invention

The present invention relates to an image forming apparatus such as a copying machine or a printer. Particularly, the present invention relates to an image forming apparatus including a rotary fixing element having a surface coated with a release agent, and to a transfer medium carrying member for use in such an image forming apparatus.

2. Related Background Art

Hitherto, various multi-color (full-color) image forming apparatuses have been proposed. A typical example of such apparatuses is a full-color electrophotographic copying machine having a developing device of the so-called rotary-type, as shown in FIG. 5.

The full-color electrophotographic copying machine will be briefly described. Referring to FIG. 5, the copying machine includes an image carrying element, comprising a photo-sensitive drum 3, rotatably supported in the apparatus in such a manner as to be rotatable in the direction a indicated by the arrow a in FIG. 5, and image forming means arranged in the outer periphery of the photo-sensitive drum 3. The image forming means may comprise any suitable constituents. In the illustrated example, the image forming means comprises a primary charger 4 for uniformly charging the surface of the photo-sensitive drum 3, an exposure means 8, such as a laser beam exposure device, for radiating a color-separated light image or a light image corresponding thereto and thus forming an electrostatic latent image on the photo-sensitive drum 3, and a rotary developing device 1 for visualizing the electrostatic latent image on the photo-sensitive drum 3.

The rotary developing device 1 includes four developing units 1Y, 1M, 1C and 1BK individually containing developers of four colors, that is, yellow (Y), magenta (M), cyan (C) and black (BK), and a substantially cylindrical casing which is rotatably supported in the apparatus and to which the four developing units 1Y, 1M, 1C and 1BK are mounted. The rotary developing device 1 is constructed such that rotation of the casing causes a desired developing unit to be moved to a position facing the outer peripheral surface of the photo-sensitive drum 3 so as to develop the electrostatic latent image on the drum 3 into a visible image of four colors (full-color development).

The visible image, that is, the toner image, on the photo-sensitive drum 3 is transferred to a transfer medium P (such as paper) being fed as carried by a transfer medium carrying element, comprising a transfer drum 9, of a transfer device, the drum 9 being rotatably supported in the apparatus for rotation in the direction b indicated by the arrow b in FIG. 5. As shown in FIG. 6, the transfer drum 9 includes a pair of cylinder portions 9*a* and 9*b* at either end of the drum 9, and a link portion 9*c* linking together both cylinder portions 9*a* and 9*b*. A transfer medium carrying member 93 extends between the non-linked regions of the respective circumferences of the cylinder portions 9*a* and 9*b*. The transfer medium carrying member 93 normally comprises a film-shaped dielectric sheet consisting of a film of a polyethylene terephthalate or polyvinylidene fluoride resin. The link portion 9*c* has a transfer medium gripper 7 for gripping transfer medium P fed from a transfer medium feed device. As shown in FIG. 5, the transfer device includes a transfer discharger 10 serving as the transferring means, and an inner charge-removal discharger 13, which are disposed on the inside of the transfer drum 9. The inner charge-removal discharger 13 constitutes charge removal means together with an outer charge-removal discharger 11 on the outside of the transfer drum 9.

A sequence of processes by which the full-color electrophotographic copying machine having the above construction forms a full-color image will be briefly described.

The primary charger 4 uniformly charges the surface of the photo-sensitive drum 3. Then, the exposure means 8 radiates a light image E corresponding to image information onto the surface, thereby forming an electrostatic latent image on the photo-sensitive drum 3. The rotary developing device 1 develops the electrostatic latent image with a toner containing a resin as a base material and having an average particle size of 12 $\mu$m, whereby the latent image is visualized as a toner image on the photo-sensitive drum 3.

Alternatively, a transfer medium P is fed by a resist roller 6 to the transfer drum 9 in synchronization with the formation of the image. When the leading end of the transfer medium P is gripped by the gripper 7, the medium is carried by the transfer drum 9 in the direction b.

In a region where the transfer drum 9 contacts the photo-sensitive drum 3, the transfer discharger 10 effects corona discharge with the opposite polarity to the toner from the reverse side of the transfer medium carrying member, that is, the reverse side of the dielectric sheet 93 of the transfer drum 9, so that the toner image on the photo-sensitive drum 3 is transferred to the surface of the transfer medium P.

After the transfer medium P has been subjected to a required number of transfer processes, the resultant transfer medium P is, while being subjected to charge removal by the charge-removal dischargers 11 and 13, separated from the transfer drum 9 by a separation pawl 15. The transfer medium P is then fed to a fixing device 17 by a conveyance belt 16. After the medium P has been subjected to fixing by heat by the fixing device 17, the resultant medium P is discharged to the outside of the apparatus.

Alternatively, the surface of the photo-sensitive drum 3 is cleaned by a cleaner 12, whereby toner remaining on the surface is removed. Thereafter, the surface of the drum 3 is used in subsequent image forming processes.

The surface of the dielectric sheet 93 of the transfer sheet 9 is cleaned by another cleaner 18 comprising a fur brush or the like and cooperating with a cleaning aid means 19. Thereafter, the surface of the dielectric sheet 93 is used in subsequent image forming processes.

The fixing device 17 employs a roller fixing method in which fixing is effected as a transfer medium having a toner image is clamped and fed by a pair of rollers, and thus pressure is applied. The fixing device 17 particularly employs a heat roller fixing method using heated rollers. In a heat roller fixing method, in order to prevent toner from offsetting, a release agent, such as a silicone oil, is coated on the fixing roller. Particularly in the case of a full-color image forming apparatus in which toner is deposited in a plurality of layers, a relatively great amount of silicone oil is coated since toner is more likely to offset.

Another example of a transfer medium which may be used is a resin film such as a transparent resin film.

Such a conventional image forming apparatus entails the following problems. When a toner image on a transfer medium is fixed by a fixing roller coated with a silicone oil or the like, the transfer medium passed through the rollers may be wet or sticky with oil, etc. This is particularly disadvantageous in the case of two-side image formation (e.g., two-side copying) in which image formation is performed in two stages, the second stage comprising forming an image on the reverse (second) surface of a transfer medium whose front (first) surface already has a fixed toner image. In this case, the second stage has a risk of oil adhering to the transfer medium being transferred and adhered to the photo-sensitive drum 3, thereby contaminating images to be formed by the subsequent image formation.

Specifically, in two-side image formation, a transfer medium, which has been subjected to fixing once, is again fed to the transfer drum 9 by the resist roller 6 in synchronization with the formation of the relevant image. Then, the transfer medium has its leading end gripped by the gripper 7, and is carried by the transfer drum 9 in the direction b shown in FIG. 5 with the first surface of the medium contacting the transfer medium carrying member, that is, the dielectric sheet 93, so that the second surface of the transfer medium is subjected to transfer processes similar to those performed with respect to the first surface. Thereafter, the resultant transfer medium is separated from the transfer drum 9, and again sent to the fixing device 17, in which fixing is performed to obtain a medium having images on both sides thereof (two-sided copy). However, when the transfer medium is separated from the transfer drum 9 after the completion of the transfer processes of the second stage, oil or other release agent is transferred from the first surface of the transfer medium to the outer surface of the dielectric sheet 93, and is adhered thereto. As a result, the oil may transfer and adhere to the surface of the photo-sensitive drum 3 during mutually-contacting rotation of the transfer and photo-sensitive drums 9 and 3. Thus, there is a risk of the photoconductor of the drum 3 being contaminated. In such a case, in the subsequent image forming sequence, the oil on the photoconductor may adsorb remaining toner or toner for development, and thus may be transferred to a transfer medium, thereby causing image contamination or fogging.

In a conventional image forming apparatus, such as above, neither the cleaner 12 nor the cleaner 18 comprising an elastic blade, etc. is able to remove oil adhering to the photo-sensitive drum 3 or the dielectric sheet 93. Consequently, once oil has adhered to a photo-sensitive drum or dielectric sheet, it has to be replaced with a new member. Thus, the above problems inevitably increase costs and decrease serviceability.

The conventional practice directed to coping with these problems includes decreasing the amount of silicone oil or other release agent coated on the fixing roller so as to decrease the amount of oil, etc. which can adhere to the first surface of a transfer medium. With this method, it is possible to prevent oil, etc. from being transferred and adhered to the photo-sensitive drum during a single execution of the two-side image formation sequence. However, when the sequence is performed a plurality of times, oil may deposit by small amounts on the dielectric sheet of the transfer drum, thereby involving the risk of oil being transferred and adhered to the photo-sensitive drum.

SUMMARY OF THE INVENTION

An object of the present invention is to provide an image forming apparatus capable of preventing a release agent from being transferred and adhered to the photo-sensitive drum.

Another object of the present invention is to provide a transfer medium carrying member effective to the prevention of unwanted transfer and adhesion of a release agent to the photo-sensitive drum.

DETAILED DESCRIPTION OF THE PREFERRED EMBODIMENTS

According to the present invention, in an image forming apparatus having a fixing device for fixing an unfixed developer image, already transferred to a transfer medium, with a rotary fixing element having a surface coated with a release agent, feed passage members for conveying a transfer medium to a transfer region of the apparatus include at least one feed passage member for contacting the transfer medium, the feed passage member having on the surface thereof a release agent absorbing layer for absorbing release agent. With this construction, in a second stage of two-side image formation (e.g., two-side copying), the release agent which has adhered to the first surface of a transfer medium (such as paper) during the first-stage image fixing is absorbed by a release agent absorbing layer on the surface of at least one feed passage member for conveying the transfer medium to the transfer region. Thus, it is possible to prevent unwanted transfer and adhesion of release agent from a transfer medium being re-fed to various devices. Accordingly, it is always possible to stably obtain images on two sides (e.g., two-sided copies) free from image contamination or fogging.

The release agent absorbing layer is formed of a material capable of absorbing a release agent such as a silicone oil, ester oil, liquid polyether, spindle oil, machine oil or cylinder oil. A preferable example of a release agent absorbing layer is a layer in which particles are dispersed in a binder resin. Examples of particles which may be used include: particles of silica, alumina, mullite or spinel; glass beads; and resin particles. In particular, particles having porous surfaces are preferable. The release agent absorbing layer may be formed on a release agent retaining layer for retaining release agent absorbed by the release agent absorbing layer. Such a release agent retaining layer serves to increase the life of the release agent absorbing layer. The release agent retaining layer may be formed of materials similar to those for forming the release agent absorbing layer. However, in order that the retaining layer be able to retain a great amount of release agent, the retaining layer preferably has a greater thickness and a smaller average particle size than the thickness and the average particle size of the release agent absorbing layer.

Image forming apparatuses according to the present invention will now be described in detail with reference to the drawings.

Each of the following first and second embodiments illustrates a transfer sheet serving as a transfer medium carrying member for use in an image forming apparatus, the sheet being usable in the type of full-color electrophotographic copying machine described with reference to FIGS. 5 and 6.

Figure 1:
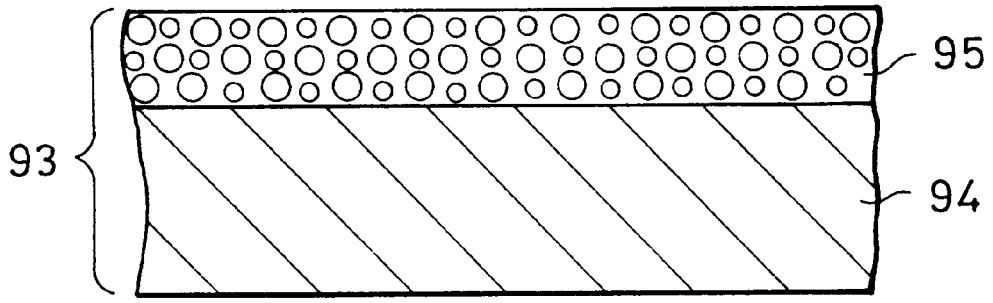
FIG. 1 is a sectional view of a transfer medium carrying member (transfer sheet) used in an image forming apparatus according to the present invention.

FIG. 1 shows, in a sectional view, a transfer sheet 93 which is an embodiment of a transfer medium carrying member according to the present invention.

Referring to FIG. 1, the transfer sheet 93 has a dielectric sheet as a substrate 94. The substrate 94 is formed of a resin such as a polyethylene terephthalate (PET), polyamide, polyimide, polyvinylidene fluoride (PVdf) or urethane resin, or of a dispersion of fine powders of carbon, metal or the like in such a resin, and has a volume resistivity controlled at a suitable value. A substrate 94 having a thickness of approximately 75 to 300 $\mu$m is advantageous with respect to various properties such as mechanical strength.

The transfer sheet 93 also has a release agent absorbing layer 95 formed on the substrate 94. The layer 95 contains spherical particles. A release agent absorbing layer 95 having a thickness of 3 to 50 $\mu$m is preferable from the viewpoint of the ability to absorb and store release agent.

EXAMPLE 1

In an example of the first embodiment, a mixture of first and second silica spherical fine particles having different average particle sizes of 2 $\mu$m and 1 $\mu$m, was prepared as spherical particles, and a styrene-acrylic resin was prepared as a binder resin. The binder resin was mixed with the spherical particle mixture. The binder resin was mixed at a ratio of 10 to 40% of the total weight of the particle-binder mixture.

If the mixing ratio between the particles and the binder is such that the binder is mixed in too small an amount, the particles cannot be sufficiently bound onto the surface of the substrate 94. An excessive amount of binder mixed is not preferable because a binder-rich condition is brought forth, where there are not sufficient pores between the spherical particles, and thus, the ability to absorb release agent may greatly deteriorate.

The mixture prepared at the above-described mixing ratio was stirred with an ordinary dispersing device and a TK-type homomixer (produced by Tokushu Kika Kogyo Kabushiki Kaisha). The stirred mixture was coated by a wire bar coating method on a substrate 94 of PET having a thickness of 100 $\mu$m in such a manner that the coating would have a dried thickness of 30 $\mu$m. Then, the coating was dried, thereby producing a transfer sheet 93 having a release agent absorbing layer 95.

When the release agent absorbing layer 95 was observed with a microscope, it was confirmed that the layer 95 was formed as a porous layer having pores between spherical particles, as shown in FIG. 1.

Figure 6:
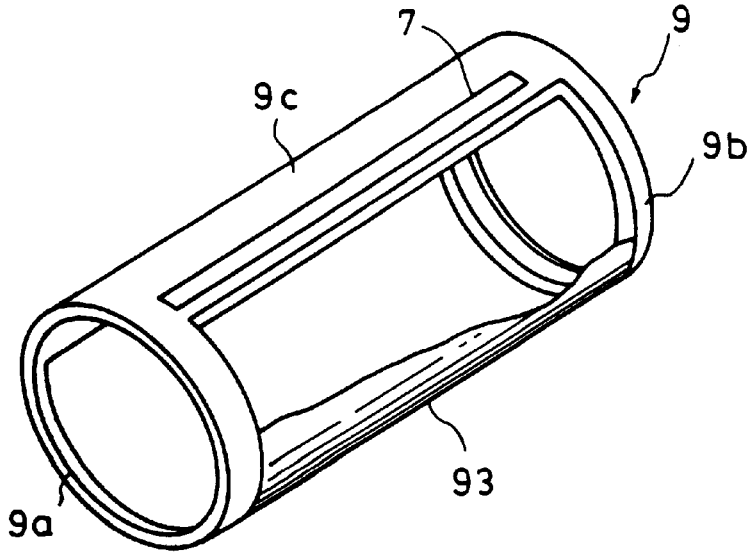
FIG. 6 is a perspective view of a transfer drum of a transfer device of the copying machine shown in FIG. 5.
Figure 5:
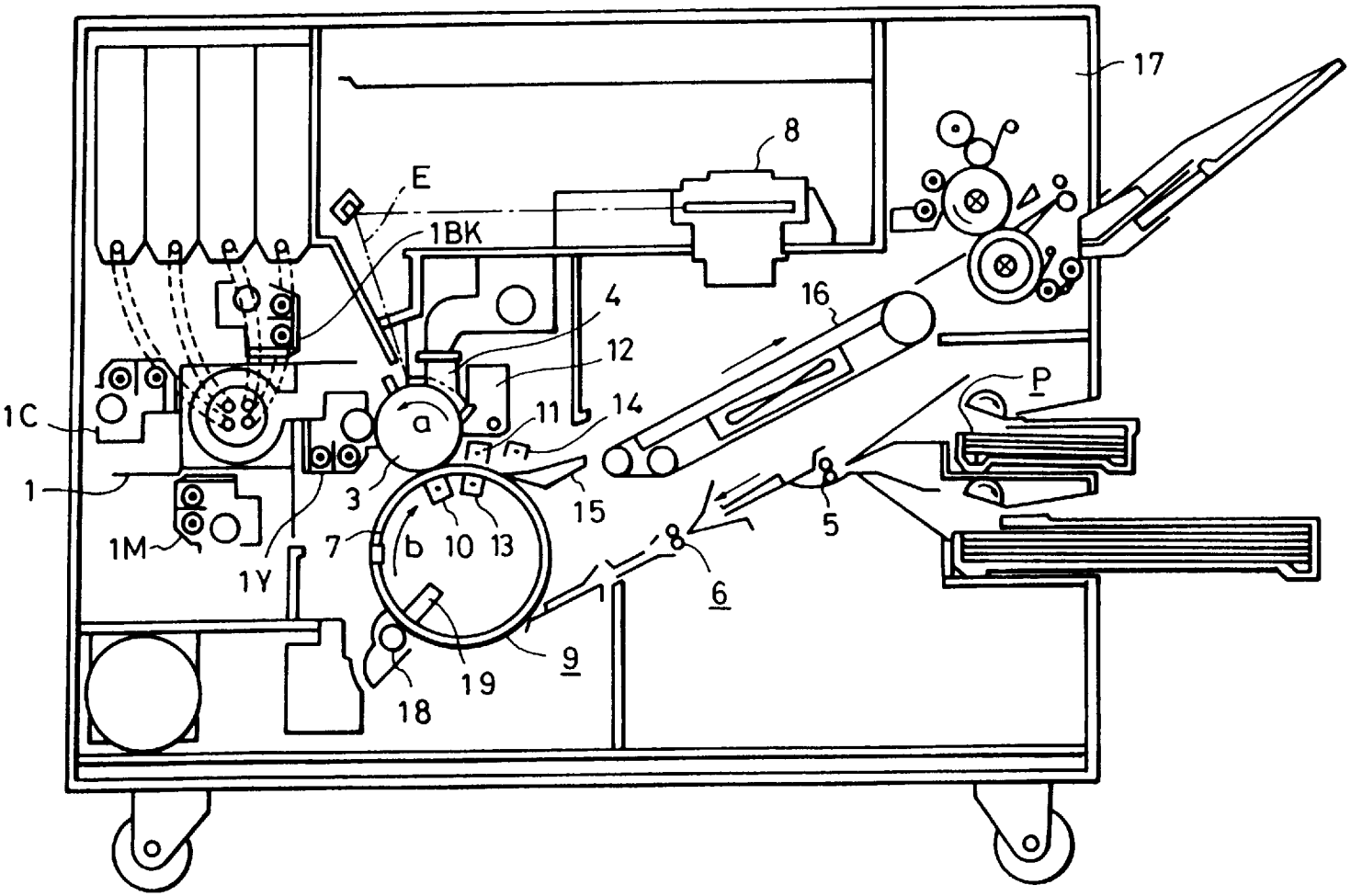
FIG. 5 is a sectional view of a general full-color electrophotographic copying machine to which the present invention may be applied.

The thus obtained transfer sheet 93 was incorporated as a transfer medium carrying member into a transfer drum 9 of the type shown in FIG. 6, and was used in two-side copying experiments conducted with a full-color electrophotographic copying machine of the type shown in FIG. 5.

In the experiments, two-side copying operations were performed at a set amount of a silicone oil, serving as a release agent, transferred and adhered to sheets of paper, serving as transfer media, in the fixing device 17 of the apparatus, the amount being set at 0.05 g per sheet of A4 size paper. As a result, good images were obtained from the very first two-side copying operation, and images obtained from a different original by a second two-side copying operation were also good. In this first two-side copying operation, no phenomenon of release agent (silicone oil) being transferred from the transfer sheet 93 to the photo-sensitive drum 3 and adhered thereto was observed.

Additional two-side copying operations, each being same as above, were conducted to obtain 30,000 sheets having copied images on both of the respective surfaces. As a result, good images were obtained, which were free from image contamination, fogging, etc. due to transfer and adhesion of silicone oil to the photo-sensitive drum 3.

In other experiments, a two-side copying operation was conducted under the same conditions as above except that the amount of transfer and adhesion of silicone oil to transfer media was set at 0.08 g per sheet of A4 size paper. As a result, good images were obtained even after the two-sided copying operation was repeated for the production of 20,000 sheets.

After the above experiments, the transfer sheet 93 was checked. As a result, it was confirmed that silicone oil was effectively absorbed and stored in the pores between the spherical particles.

EXAMPLE 2

In another example of the first embodiment, glass beads having an average particle size of 4 $\mu$m were prepared as spherical particles, and a polyester resin was prepared as a binder resin. A release agent absorbing layer 93 was formed by a method similar to that in Example 1 on a 100 $\mu$m-thick PET substrate 94 in such a manner that the layer had a dried thickness of 25 $\mu$m, thereby producing a transfer sheet 93.

The thus produced transfer sheet 93 was used in two-side copying experiments similar to those conducted in Example 1. As a result, good images free from image contamination, fogging, etc. were obtained even when the amount of transfer and adhesion of silicone oil to transfer media was set at 0.08 g per sheet of A4 size paper, or when this two-side copying operation was repeated for the production of 20,000 sheets, as in Example 1. Thus, it was confirmed that the release agent absorbing layer 95 of the transfer sheet 93 could quickly absorb silicone oil from the transfer media, and store it therein, thereby preventing transfer and adhesion of silicone coil to the photo-sensitive drum 3.

EXAMPLE 3

In still another example of the first embodiment, another transfer sheet 93 was produced in the same manner in Example 1 except that spherical silicone resin particles having an average particle size of 2 μm (trade name "Toss Pearl 120"; produced by Toshiba Silicone Kabushiki Kaisha) were prepared as spherical particles, and that a release agent absorbing layer 95 was formed on a 100 μm-thick PET substrate 94 in such a manner that the layer had a dried thickness of 40 μm.

The thus produced transfer sheet 93 was used in two-side copying experiments similar to those conducted in Example 1. As a result, good images free from image contamination, fogging, etc. were obtained even when the amount of transfer and adhesion of silicone oil to transfer media was set at 0.08 g per sheet of A4 size paper; or when this two-side copying operation was repeated for the production of 30,000 sheets. Thus, it was possible to confirm effects similar to those provided by the foregoing examples.

Figure 2:
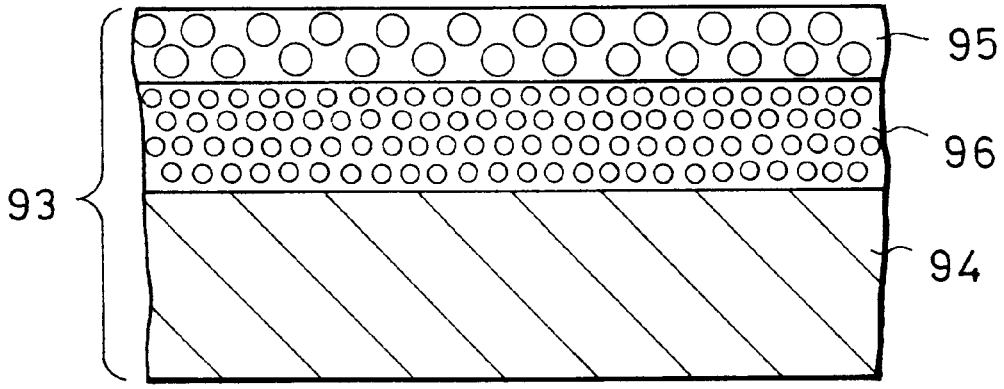
FIG. 2 is a sectional view of another transfer medium carrying member (transfer sheet) used in an image forming apparatus according to the present invention.

FIG. 2 shows, in a sectional view, a transfer sheet 93 which is another embodiment of a transfer medium carrying member according to the present invention.

Referring to FIG. 2, the transfer sheet 93 has a dielectric sheet as a substrate 94. As in the first embodiment, the substrate 94 is formed of a resin such as a polyethylene terephthalate (PET), polyamide, polyimide, polyvinylidene fluoride (PVdf) or urethane resin, or of a dispersion of fine powders of carbon, metal or the like in such a resin, and has a volume resistivity controlled at a suitable value. A substrate 94 having a thickness of approximately 75 to 300 μm is advantageous with respect to various properties such as mechanical strength.

A release agent absorbing layer 95, similar to the corresponding layer of the first embodiment, is formed on the substrate 94, and contains spherical particles. A thickness of the release agent absorbing layer 95 ranging from 3 to 50 μm is preferable from the viewpoint of the ability to absorb release agent.

The transfer sheet 93 is distinguished from the transfer sheet 93 of the first embodiment in that a release agent retaining layer 96, containing spherical particles, is provided between the substrate 94 and the release agent absorbing layer 95 . A release agent retaining layer 96 having a thickness of 3 to 30 μm is preferable from the viewpoint of ability to retain release agent.

EXAMPLE 4

In an example of the second embodiment, a release agent retaining layer 96 was formed in the following manner. Silica spherical fine particles having an average particle size of 0.5 μm were prepared as spherical particles, and a silicone-acrylic resin was prepared as a binder resin. The binder resin was mixed with the spherical particles. The binder resin was mixed at a ratio of 10 to 40% of the total weight of the particle-binder mixture.

If the mixing ratio between the particles and the binder is such that the binder is mixed in too small an amount, the particles cannot be sufficiently bound onto the surface of the substrate 94. An excessive amount of binder mixed is not preferable because a binder-rich condition is brought forth, where there are not sufficient pores between the spherical particles for retaining release agent, and thus, the release agent absorbing ability may greatly deteriorate.

The mixture prepared at the above-described mixing ratio was dispersed with a ball mill for 10 minutes, thereby preparing a coating liquid. The liquid was coated by a wire bar coating method on a substrate of PET 94 having a thickness of 100 μm in such a manner that the coating would have a dried thickness of 20 μm. Then, the coating was dried, thereby forming a release agent retaining layer 96.

When the release agent retaining layer 96 was observed with a microscope, it was confirmed that the layer 96 was formed as a porous layer having many minute pores between spherical particles, as shown in FIG. 2.

Subsequently, a release agent absorbing layer 95 was formed in the following manner. Silica spherical particles having an average particle size of 2 μm were prepared as spherical particles, and a silicone-acrylic resin, selected in view of adhesion between the binder of the release agent retaining layer 96 located inward, was prepared as a binder. The particles and the binder resin were mixed together at a mixing ratio of the binder resin of 30% by weight.

The thus obtained mixture was dispersed for 3 minutes with a homogenizer (stirrer), thereby preparing a coating liquid. The coating liquid was coated by an air spray coating method on the surface of the release agent retaining layer 96 on the PET substrate 94 in such a manner that the coating would have a dried thickness of 15 μm. Then, the coating was dried, thereby forming a release agent absorbing layer 95, and thus producing a transfer sheet 93 having release agent absorbing and retaining layers 95 and 96.

When the release agent absorbing layer 95 was observed with a microscope, it was confirmed that the layer 95 was formed as a porous layer having many pores between spherical particles, as shown in FIG. 1, the pores being larger than the pores in the release agent retaining layer 96.

The pores in these layers 95 and 96 provide the following effect with respect to a release agent such as a silicone oil. The release agent absorbed in the relatively large pores in the release agent absorbing layer 95 transfers, due to a capillary phenomenon, to the smaller pores in the inward, release agent retaining layer 96 so as to be received and retained therein.

The thus produced transfer sheet 93 was incorporated as a transfer medium carrying member into a transfer drum of the type shown in FIG. 6, and was used in two-side copying experiments conducted with a full-color electrophotographic copying machine of the type shown in FIG. 5.

In the experiments, two-side copying operations were performed at a set amount of a silicone oil, serving as a release agent, transferred and adhered to sheets of paper, serving as transfer media, in the fixing device 17 of the apparatus, the amount being set at 0.05 g per sheet of A4 size paper. As a result, good images were obtained from the very first two-side copying operation, and images obtained from a different original by a second two-side copying operation were also good. In this first two-side copying operation, no phenomenon of release agent (silicone oil) being transferred from the transfer sheet 93 to the photo-sensitive drum 3 and adhered thereto was observed.

Additional two-side copying operations, each being the same as above, were conducted to obtain 30,000 sheets having copied images on both of the respective surfaces. As a result, good images were obtained, which were free from image contamination, fogging, etc. due to transfer and adhesion of silicone oil to the photo-sensitive drum 3.

In other experiments, a two-side copying operation was conducted under the same conditions as above except that the amount of transfer and adhesion of silicone oil to transfer media was set at 0.08 g per sheet of A4 size paper. As a result, good images were obtained even after the two-sided copying operation was repeated for the production of 20,000 sheets.

After the above experiments, the transfer sheet 93 was checked. As a result, it was confirmed that silicone oil was effectively received and retained in the pores between the spherical particles of the release agent retaining layer 96.

EXAMPLE 5

In another example of the second embodiment, a release agent retaining layer 96 was formed in the following manner: a coating liquid was prepared by using alumina spherical fine particles having an average particle size of 0.4 μm as spherical particles, and a styrene-acrylic resin as a binder resin; and the coating liquid was coated by a method similar to that in Example 4 on a 100 μm-thick PET substrate 94 in such a manner that the coating had a dried thickness of 25 μm.

Subsequently, a release agent absorbing layer 95 was formed in the following manner: a coating liquid was prepared by using spherical glass beads having an average particle size of 4 μm as spherical particles, and a polyester resin as a binder resin, and the coating liquid was coated by a method similar to that in Example 4 on the surface of the release agent retaining layer 96 on the PET substrate 94 in such a manner that the coating had a dried thickness of 15 μm, thereby producing a transfer sheet 93 having release agent absorbing and retaining layers 95 and 96.

The thus produced transfer sheet 93 was used in two-side copying experiments similar to those conducted in Example 4. As a result, good images free from image contamination, fogging, etc. were obtained even when the amount of transfer and adhesion of silicone oil to transfer media was set at 0.08 g per sheet of A4 size paper, or when this two-side copying operation was repeated for the production of 20,000 sheets. Thus, it was confirmed that the release agent absorbing layer and the release agent retaining layer 95 and 96 of the transfer sheet 93 could quickly absorb silicone oil from the transfer-media, and retain it, respectively, thereby preventing transfer and adhesion of silicone oil to the photo-sensitive drum 3.

EXAMPLE 6

In still another example of the second embodiment, a release agent retaining layer 96 of another transfer sheet 93 was formed in the same manner in Example 4 except that spherical silicone resin particles having an average particle size of 2 μm (trade name "Toss Pearl 120"; produced by the same manufacturer as above) were used as spherical particles, an epoxy resin was used as a binder resin, and a release agent retaining layer 96 was formed on a 100 μm-thick PET substrate in such a manner that the layer had a dried thickness of 20 μm.

Subsequently, a release agent absorbing layer 95 of the transfer sheet 93 was formed in exactly the same manner in Example 5.

The thus produced transfer sheet 93 was used in two-side copying experiments similar to those conducted in Example 4. As a result, good images free from image contamination, fogging, etc. were obtained even when the amount of transfer and adhesion of silicone oil to transfer media was set at 0.08 g per sheet of A4 size paper, or when this two-side copying operation was repeated for the production of 30,000 sheets. Thus, it was possible to confirm effects similar to those provided by the foregoing experiments.

In each of the above embodiments, a known adhesion resin layer may be provided in order to increase the adhesion between the substrate 94 and the release agent absorbing layer 95 or the release agent retaining layer 96. The provision of such a layer does not hinder the achievement of the objects of the present invention, and may be adopted as needed.

Descriptions will now be given of a developer (toner) which can be used in an image forming apparatus according to the present invention (the apparatus may be a full-color electrophotographic copying apparatus of the type shown in FIG. 5).

In forming full-color images, it is possible to enlarge the range of color reproduction of the formed image by using a "sharp-melt" (a characteristic described below) toner.

A toner is produced by subjecting toner-forming materials, such as a binder resin (e.g., a polyester or styrene-acrylic ester resin), a coloring agent (e.g., dye or sublimable dye), and a charge controlling agent, to the processes of melting and kneading, crushing, and classifying. When necessary, a process of adding various external additives (such as hydrophobic colloidal silica) to the toner is added.

A color toner containing a polyester resin as the binder resin is particularly preferable from the viewpoint of the fixing ability and sharp-melt characteristic of the toner. An example of a polyester resin having a sharp-melt property (thus, capable of imparting a sharp-melt characteristic of a toner) is a high molecular compound synthesized from a diol compound and a dicarboxylic acid and having an ester bonding in the main chain of a molecule. A particularly preferable example is a polyester resin obtained by co-condensation polymerizing at least a diol component comprising a derivative of bisphenol or a substitute thereof, with a carboxylic acid component (e.g., fumaric acid, maleic acid, maleic acid anhydride, phthalic acid, terephthalic acid, trimellitic acid or pyromellitic acid) comprising a carboxylic acid having a valence of two or greater, an acid anhydride thereof, or a lower-alkyl ester thereof. Such a polyester resin is particularly preferable because it has a sharp-melt property, and is expressed by the following general formula:

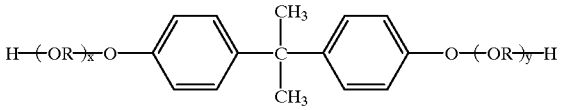

(where R represents an ethylene-or propylene group; and x and y each represent a positive integer of 1 or greater, the sum (x+y) having an average value of 2 to 10)

Figure 3:
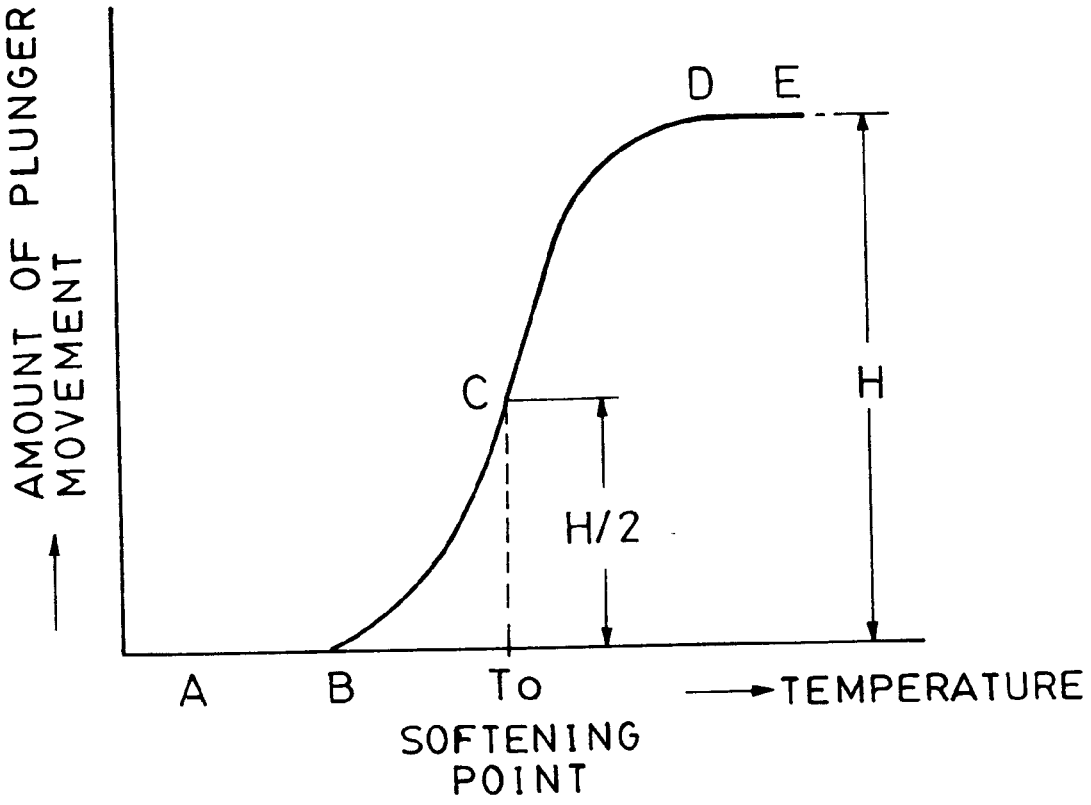
FIG. 3 is a graph showing the softening characteristic of a general toner.

A polyester resin of the above-described kind should preferably have a softening point of 75 to 150° C., more preferably, 80 to 120° C. FIG. 3 shows the softening characteristic of a toner containing a polyester resin as the binder.

A method of evaluating the softening point of a toner according to the present invention will be described with reference to FIG. 3. Using a flowtester ("CFT-500A"; produced by Shimazu Seisakusho), a sample toner (1 to 3 g of a precisely weighed fine toner powder) is subjected to an extrusion load of 20 kg with a plunger having a sectional area of 10 $cm^2$ in a die (nozzle) having an opening diameter of 0.2 mm and a wall thickness of 1.0 mm, and pre-heated for 300 seconds at an initial set temperature of 70° C. Thereafter, the temperature is raised at a constant rate of 6° C./min. When the relationship established in this process between changes in the amount of movement of the plunger and changes in the temperature is expressed by a curve, the curve is S-shaped, as shown in FIG. 3 (the curve will hereinafter be referred to as "the S-shaped curve"). That is, as the temperature raises at a constant speed, the toner is gradually heated before it starts flowing out (point A to B). Further increases in the temperature bring the toner into its molten state and cause the molten toner to flow out rapidly (points B through C to D). Thereafter, the plunger stops (points D to E).

The height H of the S-shaped curve corresponds to the total amount of outflow. The temperature $T_0$ corresponding to the point C (at H/2) indicates the softening point of the sample toner (the sample may be the binder resin).

Whether or not a toner (the binding resin) has a sharp-melt characteristic (sharp-melt property) can be determined by evaluating the apparent melt viscosity of the toner or bider resin.

According to the present invention, a toner having a sharp-melt characteristic (a binder resin having a sharp-melt property) is a toner (resin) satisfying the following conditions:

$T_1$=90 to 150° C.

$|\Delta T|=|T_1-T_2|$=5 to 20° C.

(where $T_1$ represents the temperature at which the apparent melt viscosity of the toner or resin is $10^3$ poise, and $T_2$ represents the temperature at which the apparent viscosity of the toner or resin is $5\times10^2$ poise)

A sharp-melt resin having a temperature-melt viscosity characteristic satisfying the above conditions is characterized in that when the resin is heated to a certain temperature, its melt viscosity decreases very sharply. Such a decrease in the viscosity can cause adequate mixing between the uppermost and lowermost toner layers, and rapidly increase the transparency of the toner layers, thereby assuring good subtractive color mixing.

It should be noted, however, that such a sharp-melt color toner has a high level of affinity, and tends to offset during a fixing process.

Descriptions will now be given of a fixing device which may be used in an image forming apparatus according to the present invention in which a transfer medium carrying member shown in FIG. 1 or 2 is incorporated.

Figure 4:
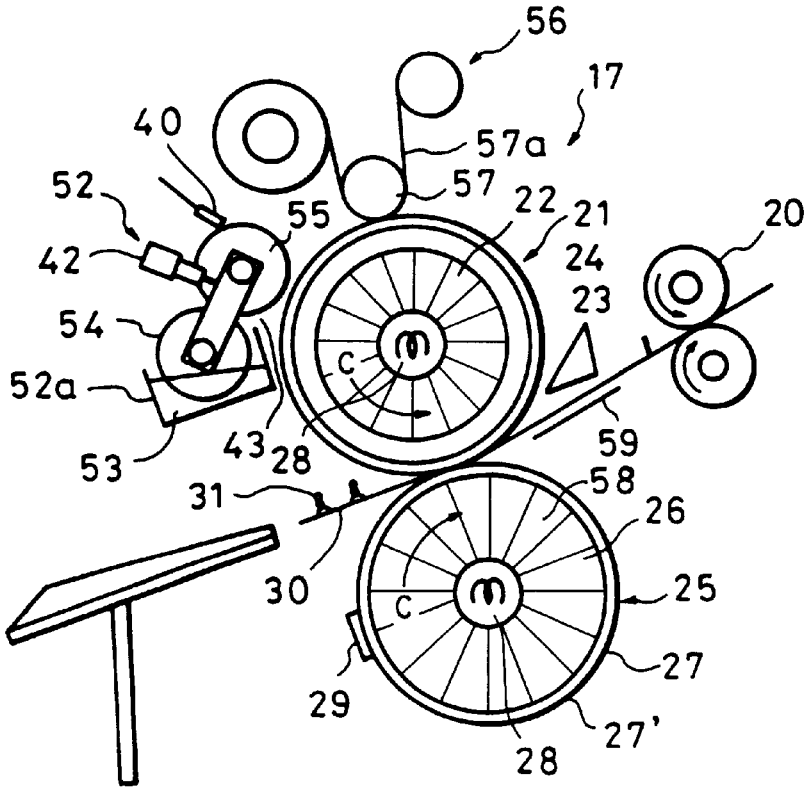
FIG. 4 is a sectional view of a fixing device of a general full-color electrophotographic copying machine to which the present invention may be applied.

FIG. 4 shows the details of a fixing device 17. The fixing device 17 includes a fixing roller 21. The fixing roller 21 has a aluminum core 22, a high-temperature vulcanized (HTV) silicone rubber layer 23 provided on the outer peripheral surface of the core 22 and having a predetermined thickness, and a low-temperature vulcanized (LTV) silicone rubber layer 24 provided as an outer (offset prevention) layer of the fixing roller 21 and having a thickness of 200 $\mu$m, the total thickness of the rubber layers 23 and 24 being 3 mm. A press roller 25 is disposed below the fixing roller 21. The press roller 25 has an aluminum core 26, a HTV silicone rubber layer 27 provided on the outer peripheral surface of the core 26 and having a thickness of 1 mm, and a resin coating 27' provided as a surface layer of the rubber layer 27. A halogen heater 28 of 400 W, serving as a heating device, is disposed in each of the fixing roller 21 and the press roller 25. A thermistor 29 is provided in contact with the press roller 25 so as to control the turning on/off of the supply of electric current to the halogen heater 28. Thus, the surface temperature of the fixing and press rollers 21 and 25 is maintained at a predetermined value (e.g., 170° C.) appropriate for fixing an unfixed toner image 31 on a transfer medium 30. The fixing and press rollers 21 and 25 are driven by a drive device, not shown, to rotate in the directions c indicated by the arrows in FIG. 4.

In order to improve the ability of the fixing roller 21 to release toner, a release agent coater 52 is provided at a certain location of the fixing device 17. The release agent coater 52 has an oil tank 52*a* containing a silicone oil 53 (e.g., "KF96 300CS"; a dimethyl silicone oil produced by Shin-etsu Kagaku Kabushiki Kaisha), and a group of coating rollers 54, 55 for pumping out silicone oil 53. The amount of pumped out silicone oil 53 is regulated by a coating amount adjusting blade 40 to a fixed amount, and the fixed amount of silicone oil 53 is coated on the fixing roller 21. The coating roller 55 is brought into contact and separated from the fixing roller 21 by a plunger 42 and a spring 43.

An amount by which a silicone oil should be coated on the fixing roller 21 is calculated in the following manner:

A silicone oil coating amount x (g) per transfer medium (e.g., per blank sheet of A4 size paper) is expressed as:

$$x=(C+A_1-B-A_2)/50$$

(where $A_1$ represents the weight (g) of fifty transfer media (fifty blank sheets of A4 size paper), B represents the weight (g) of the fifty transfer media after they have been passed through the nip (the portion of contact between the fixing and press rollers) without transferring an image to each transfer medium and without coating silicone oil on the offset prevention layer of the fixing roller, $A_2$ represents the weight (g) of another fifty transfer media (another fifty blank sheets of the above category), and C represents the weight (g) of the fifty transfer media after they have been passed through the nip between the fixing and press rollers without transferring an image to each transfer medium, with silicone oil coated on the offset prevention layer of the fixing roller)

In the fixing device 17, in order to fix a color sharp-melt toner as described above while assuring the release of such a toner which tends to offset, the coating amount (x) is set at a value substantially equal to 0.1 g ($x\approx0.1$ (g)).

Offsetting tends to occur particularly in the case of a fixing device in a color image forming apparatus since toner is deposited in a plurality of layers (corresponding to M, C, Y and BK) on a transfer medium.

In view of this fact, the timing at which an amount of release agent is coated on the fixing roller 21 by the coating roller 55 contacting with the fixing roller 21 is controlled such that the leading end of the coated release agent reaches the nip by the rotation of the fixing roller 21 earlier than the leading end of the transfer medium to be processed.

Other embodiments of the present invention will be described.

Figure 7:
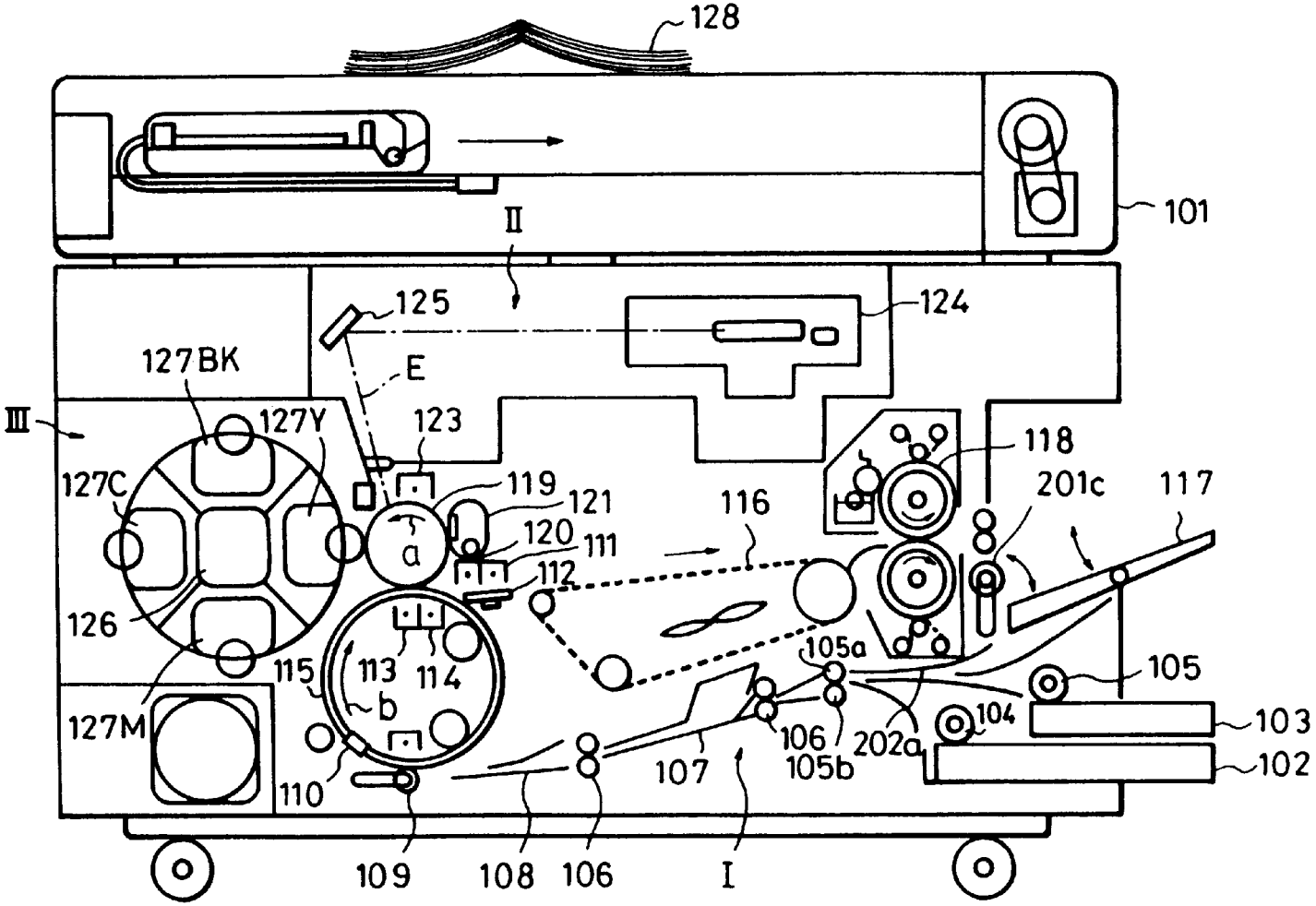
FIG. 7 is a sectional view of an image forming apparatus according to the present invention.

FIG. 7 shows another image forming apparatus, such as a color electrophotographic apparatus, according to the present invention. The apparatus mainly comprises a body 101, a transfer medium conveyance system I provided in an area ranging from a lower right (as viewed in FIG. 7) to a lower central location of the body 101, a latent image forming section II provided in the vicinity of a transfer drum 115 of the system I and in an upper central area of the body 101, and a rotary-type developing device III provided in the vicinity of the latent image forming system II.

The transfer medium conveyance system I has the following construction.

The transfer medium conveyance system I has various members defining a conveyance passageway along which a transfer medium, such as a sheet of paper, is conveyed through the interior of the body 101. Specifically, transfer medium feed trays 102 and 103 are removably engaged with the opening formed in a right wall of the body 101 of the apparatus, with rear portions of the trays 102 and 103 projecting to the outside of the apparatus. Feed rollers 104 and 105 are provided immediately above the feed trays 102 and 103. Paired feed rollers 105*a* and 105*b*, further feed rollers 106 and feed guides 107 and 108 are provided in such a manner as to connect the feed rollers 104 and 105, disposed at an upstream position of the conveyance passageway with a transfer drum 115, disposed at a downstream position of the passageway, which is rotatable in the direction b indicated by the arrow a in FIG. 7.

In the vicinity of the outer peripheral surface of the transfer drum 115, a contact roller 109, a gripper 110, an outer, transfer medium separation charger 111 and a separation pawl 112 are arranged in this order from upstream to downstream in the direction a of rotation of the drum 115. Over the inner peripheral surface of the transfer drum 115, a transfer charger 113 and an inner, transfer medium separation charger 114 are similarly arranged. A portion of the transfer drum 115 on which a transfer medium is to be wound includes a dielectric sheet, such as that shown in FIG. 6, formed of PVdf or the like, so that a transfer medium can come into electrostatic tight contact with the dielectric sheet.

A conveyance belt means 116 extends from an upstream position of the passage way which is upper right of the transfer drum 115 and close to the separation pawl 112 to a downstream position of the passageway which is lower left of a fixing device 118, such as that shown in FIG. 4. A discharge tray 117 is disposed downstream of the fixing device 118, and is removable from the body 101.

Some of the above-described members serve as feed passage members defining a feed passage through which a transfer medium is fed to a transfer region of the apparatus.

The latent image forming section II has the following construction.

A photo-sensitive drum 119, serving as an image carrying element, is rotatable in the direction b indicated by the arrow a, is disposed with the outer peripheral surface thereof kept in contact with the outer peripheral surface of the transfer drum 115. Above the photo-sensitive drum 119, a charge removal charger 120, a cleaning means 121 and a primary charger 123 are arranged in this order from upstream to downstream in the direction b of rotation of the photo-sensitive drum 119. Further above the photo-sensitive drum 119, an exposure means 124, such as a laser beam scanner, for forming an electrostatic latent image on the photo-sensitive drum 119, and a light reflecting means 125, such as a mirror, are disposed.

The rotary-type developing device III has the following construction.

A rotary casing 126 is rotatably disposed at a position opposing the outer peripheral surface of the photo-sensitive drum 119. Four developing units 127Y, 127M, 127C and 127BK, respectively corresponding to Y, M, C and BK, are mounted to the rotary casing 126 at four different circumferential positions of the casing 126, so that an electrostatic latent image formed on a portion of the outer peripheral surface of the photo-sensitive drum 119 can be developed and thus visualized by the developing units 127Y, 127M, 127C and 127BK.

A sequence in, for example, a full-color mode of the color electrophotographic apparatus will be described When the photo-sensitive drum 119 rotates in the direction a, a photoconductor on the photo-sensitive drum 119 is uniformly charged by the primary charger 123. In this process, the speed of operation (hereinafter referred to as the process speed) is set at 160 mm/sec.

When the photoconductor on the photo-sensitive drum 119 has thus been uniformly charged, the photoconductor is exposed to a laser beam E modulated by a yellow image signal obtained from an original 128, thereby forming an electrostatic latent image on the drum 119. The rotary casing 126 rotates to move the yellow developing unit 127Y to the development position, so that the electrostatic latent image is developed into a yellow developed-image component.

A transfer medium which has been fed through the feed rollers 106 and feed guides 107 and 108 is gripped at a predetermined timing by the gripper 110, and wound on the transfer drum 115 in such a manner that the transfer medium is brought into electrostatic tight contact by the contact roller 109 and an electrode opposing the contact roller 109. At this time, the transfer drum 115 rotates in synchronization with the photo-sensitive drum 119 in the direction b, so that the developed image developed by the yellow developing unit 127Y is transferred, by the transfer charger 113, to the transfer medium at a portion where the outer peripheral surface of the photo-sensitive drum 119 contacts that of the transfer drum 115. Thereafter, the transfer drum 115 continues its rotation and prepares for the transfer of another developed-image component (magenta component, in the illustrated example).

Alternatively, the surface of the photo-sensitive drum 119 used in the above process is subjected to charge removal by the removal charger 120, and is cleaned by the cleaning means 121 by a known cleaning method using a blade. Thereafter, the surface is again charged by the primary charger 123, and then exposed in accordance with another image signal (magenta image signal), thereby forming another electrostatic latent image on the photo-sensitive drum 119. In the rotary-type developing device III, the rotary casing 126 rotates during the period during which that electrostatic latent image is formed by the above exposure, so that the magenta developing unit 127M is positioned at the predetermined developing position, and development into a magenta developed-image component is performed.

Subsequently, processes similar to the above are performed with respect to the remaining colors C and BK. When transfer for all four colors has been completed, a four-color developed image on the transfer medium is discharged by the chargers 111 and 114, the transfer medium is released from the gripper 110, and separated from the transfer drum 115 by the separation pawl 112. Then, the transfer medium is conveyed by the conveyance belt means 116 to the fixing device 118, in which the transferred image is fixed by the application of heat and pressure, thereby completing the execution of the sequence for full-color image formation (e.g., full-color printing or copying). The speed of the fixing operation of the fixing device 118 is 90 mm.sec., which is lower than the above-stated process speed of 160 mm.sec. This is because of a certain characteristic requirement of a color electrophotographic apparatus which will be described below. In such an apparatus, in order to melt and mix toners of an unfixed image which are deposited in two to four layers, it is necessary to adequately heat the toners. Thus, a fixing operation is performed at a speed lower than the process speed so as to increase the amount of heat applied to the toners.

A color electrophotographic apparatus, in which toners of a plurality of colors are deposited two to 4 layers to form a color image, is distinguished from an electrophotographic apparatus for forming black-and-white images in that it is necessary to use toners having good abilities of melting and mixing when heated. In order to meet this requirement, a sharp-melt toner having a relatively low softening point and a relatively low melt viscosity is used. When a sharp-melt toner is used, it is possible to enlarge the range of color reproduction of formed images (copies, etc.), and thus produce color images faithful to the original multi-color or full-color image(s).

Figure 8:
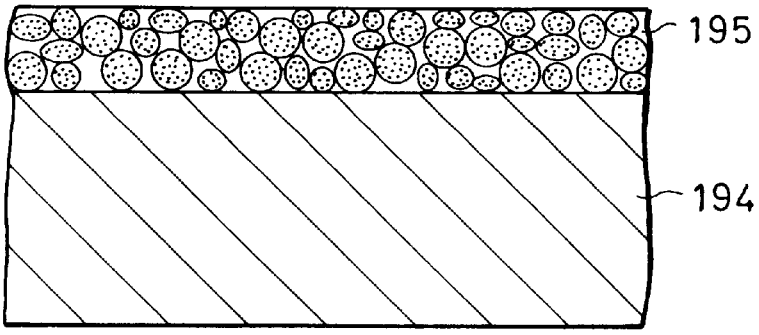
FIG. 8 is a sectional view of the relevant parts of a member having a release agent absorbing layer, and being used in an image forming apparatus according to the present invention.

According to the present invention, the color electrophotographic apparatus includes certain transfer medium feed passage members, specifically, a pick-up roller 201*c*, a feed guide 202*a*, and a resist roller 105*a*, each of which has the construction shown in FIG. 8.

Referring to FIG. 8, each of these members 201*c*, 202*a* and 105*a* has a base 194 formed of a material such as a metal, a resin, a hard rubber or a ceramic material. A release agent absorbing layer 195 containing porous particles is formed on the base 194.

From the viewpoint of the ability to absorb and store release agent, the release agent absorbing layer 195 preferably has a thickness of not less than 10 μm.

Examples of particles which may be contained in the release agent absorbing layer 195 are particles having an average pore size of 0.02 to 2 μm and an average particle size of 0.1 to 50 μm, and being formed of a suitable inorganic material such as silica, silica alumina, alumina, mullite or spinel.

Example 7

In an example of the third embodiment, a release agent absorbing layer 195 was formed in the following manner. Porous granulated silica particles having an average particle size of 20 μm were prepared as particles to be contained in the layer 195. A thermoplastic or thermosetting resin such as a styrene-acrylic resin was prepared as a binder resin for the layer 195. The binder resin was mixed with the particles. The binder resin was mixed at a ratio of 10 to 60% of the total weight of the particle-binder mixture.

If the mixing ratio between the particles and the binder is such that the binder is mixed in too small an amount, the particles cannot be sufficiently bound onto the surface of the base 194. An excessive amount of binder mixed is not preferable because a binder-rich condition is brought forth, where fine pores of the particles may be covered with resin or there may not be sufficient pores between the particles, and thus, the ability to absorb release agent may greatly deteriorate.

The mixture prepared at the above-described mixing ratio was stirred with an ordinary dispersing device and a TK-type homomixer (produced by the same manufacturer as above), thereby obtaining a coating liquid. The coating liquid was coated by a known coating method on the surfaces of uncoated bases 194, that is, a pick-up roller 201*c*, a feed guide 202*a*, and a resist roller 105*a* in such a manner that the coating would have a dried thickness of 100 μm. Then, the coating was dried, thereby forming a release agent absorbing layer 195 on each of the members 201*c*, 202*a* and 105*a*.

When each release agent absorbing layer 195 was observed with a microscope, the layer 195 was formed as a porous layer having pores in porous particles, as shown in FIG. 8.

The thus obtained pick-up roller 201*c*, feed guide 202*a* and resist roller 105*a*, each having a release agent absorbing layer 195 on the surface thereof, were incorporated in a full-color electrophotographic copying apparatus of the type shown in FIG. 7, and were used in two-side copying experiments.

In the experiments, two-side copying operations were performed at a set amount of a silicone oil, serving as a release agent, transferred and adhered to sheets of paper, serving as transfer media, in the fixing device 17 of the apparatus, the amount being set at 0.05 g per sheet of A4 size paper. As a result, good images were obtained from the very first two-side copying operation, and images obtained from a different original by a second two-side copying operation were also good. In this first two-side copying operation, no phenomenon of release agent (silicone oil) being transferred to the transfer drum 115, serving as the transfer medium carrying element, or the photo-sensitive drum 119, serving as the image carrying element, and adhered thereto was observed.

Additional two-side copying operations, each being the same as above, were conducted to obtain 30,000 sheets having copied images on both of the respective surfaces. As a result, good images were obtained, which were free from image contamination or fogging due to transfer and adhesion of silicone oil to the photo-sensitive drum 119.

In other experiments, a two-side copying operation was conducted under the same conditions as above except that the amount of transfer and adhesion of silicone oil to transfer media was set at 0.08 g per sheet of A4 size paper. As a result, good images were obtained even after the two-sided copying operation was repeated for the production of 30,000 sheets.

After the above experiments, the release agent absorbing layer 195 was checked. As a result, it was confirmed that silicone oil was effectively absorbed and stored in the pores in the porous particles and pores between the particles.

EXAMPLE 8

Figure 9:
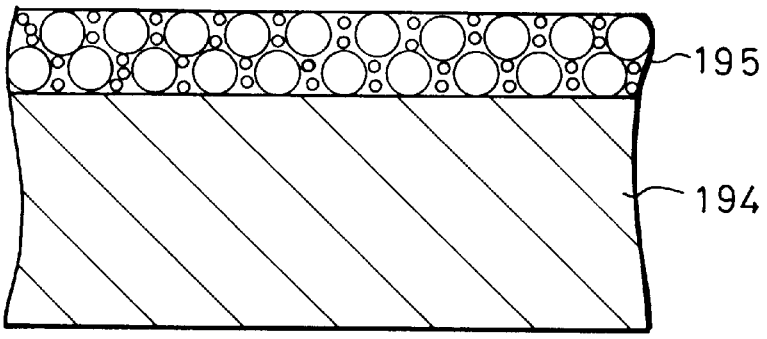
FIG. 9 is a sectional view of the relevant parts of another member having a release agent absorbing layer, and being used in an image forming apparatus according to the present invention.

Another example of the third embodiment was distinguished from Example 7 in that a release agent absorbing layer 195, shown in FIG. 9 was formed. In order to prepare a coating liquid for the layer 195, glass beads having an average particle size of 10 μm and spherical alumina fine particles having an average particle size of 1 μm were dispersed in a binder resin of the same type as that in Example 7. The coating liquid was coated exactly as in Example 7 by a known coating method on the surfaces of uncoated bases 194, that is, a pick-up roller 201*c*, a feed guide 202*a* and a resist roller 105*a* in such a manner that the layers had a dried thickness of 100 μm.

When each release agent absorbing layer 195 was observed with a microscope, it was confirmed that spherical alumina particles were dispersed among glass beads in the layer 195, and thus, the layer 195 was formed as a porous layer having pores of various sizes, as shown in FIG. 9.

The thus obtained pick-up roller 201*c*, feed guide 202*a* and resist roller 105*a*, each having a release agent absorbing layer 195, on the surface thereof, were incorporated in a full-color electrophotographic copying apparatus of the type shown in FIG. 7, and were used in two-side copying experiments similar to those in Example 7.

As a result, good images free from image contamination or fogging were obtained when the amount of transfer and adhesion of silicone oil to transfer media in the fixing device 118 was set at 0.08 g per sheet of A4 size paper, and two-side copying operations were conducted under this condition for the production of 30,000 sheets. Thus, it was confirmed that the release agent absorbing layers 195 could quickly absorb silicone oil, and store it therein, thereby preventing transfer and adhesion of silicone coil to the transfer drum 115 (transfer medium carrying element) or the photo-sensitive drum 119 (image carrying element).

EXAMPLE 9

Figure 10:
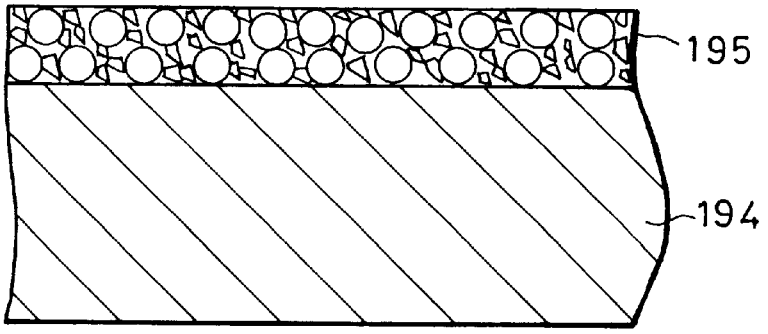
FIG. 10 is a sectional view of the relevant parts of still another member having a release agent absorbing layer, and being used in an image forming apparatus according to the present invention.

Still another example of the third embodiment is distinguished from Example 7 in that a release agent absorbing layer 195, shown in FIG. 10 was formed. In order to prepare a coating liquid for the layer 195, glass beads having an average particle size of 10 μm and alumina particles of indefinite shapes having an average particle size of 3 μm were dispersed in a binder resin of the same type as that in Example 7. The coating liquid was coated exactly as in Example 7, that is, by a known coating method on the surfaces of uncoated bases 194, that is, a pick-up roller 201*c*, a feed guide 202*a* and a resist roller 105*a* in such a manner that the layers had a dried thickness of 150 μm. Here, the term "indefinite shapes" indicate that the particles have shapes except for spherical or ellipsoidal shapes, and normally consist of particles crushed into various shapes.

When each release agent absorbing layer 195 was observed with a microscope, it was confirmed that alumina particles of indefinite shapes were dispersed among glass beads in the layer 195, and thus, the layer 195 was formed as a porous layer having pores of various sizes, as shown in FIG. 10.

The thus obtained pick-up roller 201*c*, feed guide 202*a* and resist roller 105*a*, each having a release agent absorbing layer 195, on the surface thereof, were incorporated in a full-color electrophotographic copying apparatus of the type shown in FIG. 7, and were used in two-side copying experiments similar to those in Example 7.

As a result, good images free from image contamination or fogging were obtained when the amount of transfer and adhesion of silicone oil to transfer media in the fixing device 118 was set at 0.08 g per sheet of A4 size paper, and two-side copying operations were conducted under this condition for the production of 50,000 sheets. Thus, it was confirmed that the release agent absorbing layers 195 could quickly absorb silicone oil, and store it therein, thereby preventing transfer and adhesion of silicone coil to the transfer drum 115 or the photo-sensitive drum 119.

EXAMPLE 10

A further example of the third embodiment was distinguished from Example 7 in that each of a pick-up roller 201*c* and a resist roller 105*a* had a release agent absorbing layer 195 formed of a porous ceramic material, and that a feed guide 202*a* had a release agent absorbing layer 195 containing porous granulated silica particles having an average particle size of 20 μm. Examples of porous ceramic materials which may be used include porous sintered materials of alumina ($Al_2O_3$) or cordierite ($2MgO.2Al_2O_3.5SiO_2$)

The pick-up roller 201*c*, feed guide 202*a* and resist roller 105*a* having the above-described release agent absorbing layers 195 on the surface thereof were incorporated in a full-color electrophotographic copying apparatus of the type shown in FIG. 7, and were used in experiments similar to those in Example 7.

When two-side copying experiments were conducted for the production of 80,000 sheets, good images free from image contamination or fogging were obtained. Thus, it was confirmed that the release agent absorbing layers 195 could quickly absorb silicone oil, and store it therein, thereby preventing transfer and adhesion of silicone coil to the transfer drum 115 or the photo-sensitive drum 119.

EXAMPLE 11

A still further example of the third embodiment was distinguished from Example 10 in that the pick-up roller 201*c* and the resist roller 105*a* of Example 10, each having a release agent absorbing layer 195 of a porous ceramic material, were substituted by pick-up and resist rollers formed of a plastic porous sintered material ("Sunfine AQ"; produced by Asahi Kasei Kogyo Kabushiki Kaisha).

The thus prepared members were used in experiments similar to those in Example 10. As a result, good images free from image contamination or fogging due to transfer and adhesion of silicone oil were obtained even when two-side copying operations were conducted for the production of 80,000 sheets.

It is to be understood that the release agent absorbing layer 195 according to the present invention is not intended to be limited to those described above. Other porous materials or release agent absorbing materials, such as other particles or foamed metals, may be suitably used.

Figure 11:
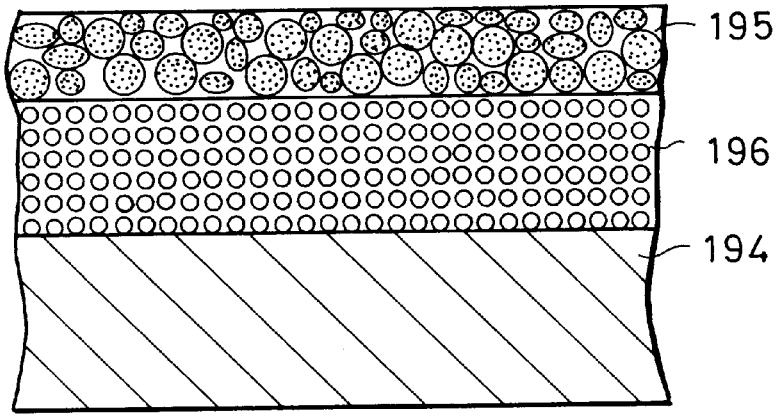
FIG. 11 is a sectional view of the relevant parts of a further member having a release agent absorbing layer and a release agent retaining layer, and being used in an image forming apparatus according to the present invention.

In another embodiment of the present invention, an image forming apparatus of the type shown in FIG. 7 incorporates certain transfer medium feed passage members, specifically, a pick-up roller 201*c*, a feed guide 202*a* and a resist roller 105*a*, each of which has the construction shown in FIG. 11.

Referring to FIG. 11, each of these members 201*c*, 202*a* and 105*a* has a base 194 formed of a material such as a metal, a resin, a hard rubber or a ceramic material. A release agent retaining layer 196 is formed on the base 194, and a release agent absorbing layer 195 containing porous particles is further formed on the release agent retaining layer 196.

The release agent absorbing layer 195 preferably has a thickness of not less than 3 μm from the viewpoint of the ability to absorb and store release agent.

Examples of particles which may be contained in the release agent absorbing layer 195 are particles having an average pore size of 0.01 to 2 μm, and an average particle size of 0.1 to 50 μm, and being formed of a suitable inorganic material such as silica, silica alumina, alumina, mullite or spinel.

The layer 196 preferably has a thickness of not less than 3 μm from the viewpoint of the ability to retain release agent.

Examples of particles which may be contained in the release agent retaining layer 196 are particles having an average pore size of 0.01 to 2 μm, and an average particle size of 0.1 to 50 μm, and being formed of a suitable inorganic material such as silica; silica alumina, alumina, mullite or spinel, as in the case of the release agent absorbing layer 195.

EXAMPLE 12

In an example of the fourth embodiment, a particle-binder mixture for forming a release agent retaining layer 196 was prepared in the following manner. Porous granulated silica fine particles having an average particle size of 1.0 μm were prepared as particles to be contained in the layer 196. A thermoplastic or thermosetting resin such as a styrene-acrylic resin was prepared as a binder resin for the layer 196. The binder resin was mixed with the particles. The binder resin was mixed at a ratio of 10 to 60% of the total weight of the particle-binder mixture.

If the mixing ratio between the particles and the binder is such that the binder is mixed in too small an amount, the particles cannot be sufficiently bound onto the surface of the base 194. An excessive amount of binder mixed is not preferable because a binder-rich condition is brought forth, where fine pores of the particles may be covered with resin or there may not be sufficient pores between the particles, and thus, the ability to retain release agent may greatly deteriorate.

A particle-binder mixture for forming a release agent absorbing layer 195 was prepared in the following manner. Porous granulated silica particles having an average particle size of 20 μm were prepared as particles to be contained in the layer 195. A thermoplastic or thermosetting resin such as a styrene-acrylic resin was prepared as a binder resin for the layer 195, as in the case of the layer 196. The binder resin was mixed with the particles. The binder resin was mixed at a ratio of 10 to 60% of the total weight of the particle-binder mixture.

If the mixing ratio between the particles and the binder is such that the binder is mixed in too small an amount, this is not preferable because the particles cannot be sufficiently bound onto the surface of the release agent retaining layer 196. An excessive amount of binder mixed is not preferable because a binder-rich condition is brought forth, where fine pores of the particles may be covered with resin or there may not be sufficient pores between the particles, and thus, the ability to absorb release agent may greatly deteriorate.

The mixture prepared for the release agent retaining layer 196 was dispersed with a ball mill, thereby preparing a coating liquid. The coating liquid was coated by a known coating method on the surfaces of uncoated bases 194, that is, a pick-up roller 201*c*, a feed guide 202*a*, and a resist roller 105*a* in such a manner that the coating would have a dried thickness of 100 μm. Then, the coating was dried, thereby forming a release agent retaining layer 196 on each of the members 201*c*, 202*a* and 105*a*.

When each release agent retaining layer 196 was observed with a microscope, the layer 196 was formed as a porous layer having minute pores between porous particles, as shown in FIG. 11.

Subsequently, the mixture prepared for the release agent absorbing layer 195 was stirred for 3 minutes with an ordinary dispersing device and a TK-type homomixer (produced by the same manufacturer as above), thereby preparing a coating liquid. The coating liquid was coated by an air spray coating method on the surface of the release agent retaining layers 196 already formed on the pick-up roller 201*c*, feed guide 202*a*, and resist roller 105*a* in such a manner that the coating would have a dried thickness of 15 μm. Then, the coating was dried, thereby forming a release agent absorbing layer 95 on each of the members 201*c*, 202*a* and 105*a*.

When the release agent absorbing layer 195 was observed with a microscope, it was confirmed that the layer 195 was formed as a porous layer having a multiplicity of pores between porous granulated silica particles, as shown in FIG. 11, the pores being larger than the pores in the release agent retaining layer 196.

The pores in these layers 195 and 196 provide the following effect with respect to a release agent such as a silicone oil. The release agent absorbed in the relatively large pores in the release agent absorbing layer 195 transfers, due to a capillary phenomenon, to the smaller pores in the inward, to the release agent retaining layer 196 so as to be received and retained therein.

The thus obtained pick-up roller 201*c*, feed guide 202*a* and resist roller 105*a*, each having a release agent retaining layer 196 and a release agent absorbing layer 195 on the surface thereof, were incorporated in a full-color electrophotographic copying apparatus of the type shown in FIG. 7, and were used in two-side copying experiments.

In the experiments, two-side copying operations were performed at a set amount of a silicone oil, serving as a release agent, transferred and adhered to sheets of paper, serving as transfer media, in the fixing device 118 of the apparatus, the amount being set at 0.05 g per sheet of A4 size paper. As a result, good images were obtained. In this first two-side copying operation, no phenomenon of release agent (silicone oil) being transferred to the transfer drum 115 (the transfer medium carrying element) or the photosensitive drum 119 (the image carrying element) and adhered thereto was observed.

Additional two-side copying operations, each being same as above, were conducted to obtain 50,000 sheets having copied images on both of the respective surfaces. As a result, good images were obtained, which were free from image contamination or fogging due to transfer and adhesion of silicone oil to the photo-sensitive drum 119.

In other experiments, a two-side copying operation was conducted under the same conditions as above except that the amount of transfer and adhesion of silicone oil to transfer media was set at 0.08 g per sheet of A4 size paper. As a result, good images were obtained even after the two-sided copying operation was repeated for the production of 50,000 sheets.

After the above experiments, each of the release agent absorbing layer 195 and the release agent retaining layer 196 was checked. As a result, it was confirmed that silicone oil was effectively absorbed and stored in the pores in the porous particles and pores between the particles.

EXAMPLE 13

Figure 12:
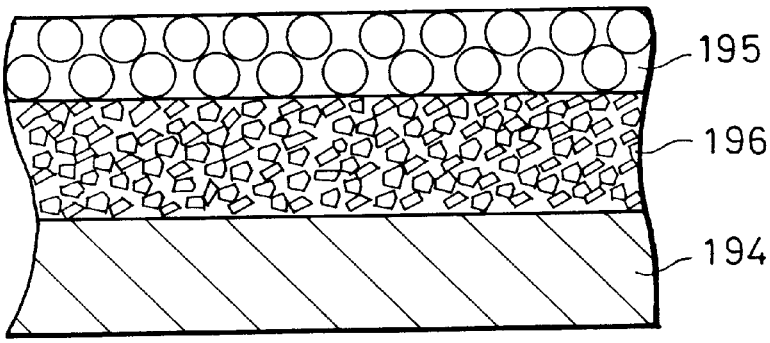
FIG. 12 is a sectional view of the relevant parts of a further member having a release agent absorbing layer and a release agent retaining layer, and being used in an image forming apparatus according to the present invention.

Another example of the third embodiment is distinguished from Example 12 in that a release agent absorbing layer 195 and a release agent retaining layer 196, shown in FIG. 12 were formed. The release agent retaining layer 196 was formed by preparing a coating liquid in the same manner as in Example 12 except that alumina fine particles of indefinite shapes having an average particles size of 1.2 μm were dispersed in a binder resin, and by coating the coating liquid in the same manner as in Example 12, thereby forming a release agent retaining layer 196 on a pick-up roller 201*c*, a feed guide 202*a* and a resist roller 105*a*. The term "indefinite shapes" indicate that the particles have shapes except for spherical or ellipsoidal shapes, and normally consist of particles crushed into various shapes.

The release layer 195 was formed by preparing a coating liquid in the same manner as in Example 12 except that glass beads having an average particle size of 10 μm were mixed with a binder resin, and by coating the coating liquid in the same manner as in Example 12 on the release agent retaining layer 196 already formed on each of the pick-up roller 201*c*, feed guide 202*a* and resist roller 105*a*.

When each of the release agent absorbing layer 195 and the release agent absorbing layer 106 was observed with a microscope, it was confirmed that there were a multiplicity of minute pores in the release agent retaining layer 196, and there were a multiplicity of relatively large pores in the release agent absorbing layer 195, as shown in FIG. 12.

The thus obtained pick-up roller 201*c*, feed guide 202*a* and resist roller 105*a*, each having a release agent absorbing layer 195 and a release agent retaining layer 196 on the surface thereof, were incorporated in a full-color electrophotographic copying apparatus of the type shown in FIG. 7, and were used in two-side copying experiments similar to those in Example 12.

As a result, good images free from image contamination or fogging were obtained when the amount of transfer and adhesion of silicone oil to transfer media in the fixing device 118 was set at 0.08 g per sheet of A4 size paper, and two-side copying operations were conducted under this condition for the production of 50,000 sheets. Thus, it was confirmed that the release agent absorbing layers 195 and the release agent retaining layers 196 could quickly absorb and retain silicone oil, thereby preventing transfer and adhesion of silicone coil to the transfer drum 115 or the photo-sensitive drum 119.

EXAMPLE 14

Figure 13:
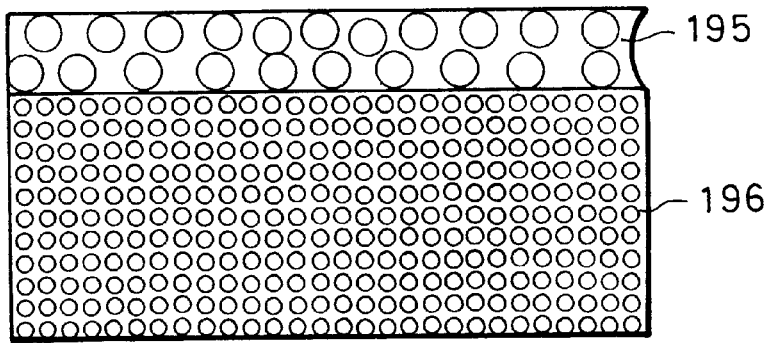
FIG. 13 is a sectional view of the relevant parts of a further member having a release agent absorbing layer and a release agent retaining layer, and being used in an image forming apparatus according to the present invention.

Still another example of the fourth embodiment was distinguished from Example 12 in that a release agent absorbing layer 195 and a release agent retaining layer 196, shown in FIG. 13 were formed. With respect to the release agent retaining layer 196, each of a pick-up roller 201*c* and a resist roller 105*a* had a release agent retaining layer 196 formed of a porous ceramic material, while a feed guide 202*a* had a release agent retaining layer 196 of the same type as that in Example 12. Examples of porous ceramic materials which may be used include porous sintered materials of alumina ($Al_2O_3$) or cordierite ($2MgO.2Al_2O_3.5SiO_2$) The release layer 195 was formed by preparing a coating liquid in the same manner as in Example 12 except that glass beads having an average particle size of 10 $\mu$m were mixed with a binder resin, and by coating the coating liquid in the same manner as in Example 12 on the release agent retaining layer 196 already formed on each of the pick-up roller 201*c*, feed guide 202*a* and resist roller 105*a*.

When each of the release agent absorbing layer 195 and the release agent absorbing layer 106 was observed with a microscope, it was confirmed that the release agent retaining layer 196 had a multiplicity of minute pores therein, and the release agent absorbing layer 195 had a multiplicity of relatively large pores therein, as shown in FIG. 13.

The thus obtained pick-up roller 201*c*, feed guide 202*a* and resist roller 105*a*, each having a release agent absorbing layer 195 and a release agent retaining layer 196 on the surface thereof, were incorporated in a full-color electrophotographic copying apparatus of the type shown in FIG. 7, and were used in two-side copying experiments similar to those in Example 12.

As a result, good images free from image contamination or fogging were obtained when the amount of transfer and adhesion of silicone oil to transfer media in the fixing device 118 was set at 0.08 g per sheet of A4 size paper, and two-side copying operations were conducted under this condition for the production of 100,000 sheets. Thus, it was confirmed that the release agent absorbing layers 195 and the release agent retaining layers 196 could quickly absorb and retain silicone oil, thereby preventing transfer and adhesion of silicone coil to the transfer drum 115 or the photo-sensitive drum 119.

EXAMPLE 15

A further example of the fourth embodiment was distinguished from Example 14 in that the pick-up roller 201*c* and the resist roller 105*a* of Example 14, each having a release agent retaining layer 196 of a porous ceramic material, were substituted by pick-up and resist rollers each having a release agent retaining layer formed of a plastic porous sintered material ("Sunfine AQ"; produced by the same manufacturer as above). A release agent absorbing layer which was the same as that in Example 14 was formed on each of the release agent retaining layers 196.

The thus prepared pick-up roller 201*c*, feed guide 202*a* and resist roller 105*a* were used in experiments similar to those in Example 14. As a result, good images free from image contamination or fogging due to transfer and adhesion of silicone oil were obtained even when two-side copying operations were conducted for the production of 100,000 sheets.

It is to be understood that the release agent absorbing layer 195 and the release agent retaining layer 196 according to the present invention are not intended to be limited to those described above. Other porous materials or release agent absorbing materials, such as other particles or foamed metals, may be suitably used.

What is claimed is:

1. An image forming apparatus having a fixing device for fixing an unfixed developer image already transferred to a transfer medium, said fixing device including a rotary fixing element having a surface coated with a release agent, said image forming apparatus comprising:

feed passage members for conveying a transfer medium having a fixed developer image from the fixing device to a transfer region of said apparatus, wherein said feed passage members include at least one feed passage member for contacting the transfer medium, said feed passage member having on the surface thereof a release agent absorbing layer for absorbing release agent, wherein said release agent absorbing layer is formed on a release agent retaining layer for retaining release agent absorbed by said release agent absorbing layer.

2. An image forming apparatus according to claim 1, wherein said release agent retaining layer comprises a porous layer containing particles and a binder resin.

3. An image forming apparatus according to claim 2, wherein said release agent retaining layer contains particles having an average particle size smaller than the average particle size of particles contained in said release agent absorbing layer.

4. An image forming apparatus according to claim 1, wherein said release agent absorbing layer contains porous particles.

5. An image forming apparatus according to claim 1, wherein said release agent absorbing layer contains particles and a binder resin.

6. A transfer medium carrying member, having on the surface thereof a release agent absorbing layer containing porous particles and a binder resin, wherein said release agent absorbing layer is formed on a release agent retaining layer for retaining release agent absorbed by said release agent absorbing layer.

7. A transfer medium carrying member according to claim 6, wherein said release agent retaining layer comprises a porous layer containing particles and a binder resin.

8. A transfer medium carrying member according to claim 7, wherein said release agent retaining layer contains particles having an average particle size smaller than the average particle size of particles contained in said release agent absorbing layer.

* * * * *

UNITED STATES PATENT AND TRADEMARK OFFICE

CERTIFICATE OF CORRECTION

PATENT NO. : 5,903,802

DATED : May 11, 1999

INVENTOR(S) : AKIRA WATANABE ET AL.

It is certified that error appears in the above-identified patent and that said Letters Patent is hereby corrected as shown below:

ON THE TITLE PAGE [75]

Inventors, "Jiro Ishizuka, Tokyo" should read --Jiro Ishizuka, Machida--.

COLUMN 4

Line 2, "to" should read --for--.

COLUMN 7

Line 54, "95 ." should read --95.--

COLUMN 9

Line 47, "transfer-media," should read --transfer media,--.

COLUMN 10

Line 55, "ethylene-or" should read --ethylene or--.

COLUMN 11

Line 10, "raises" should read --rises--;
Line 20, "binding" should read --binder--;
Line 22, "bider" should read --binder--; and
Line 53, "a" (first occurrence) should read --an--.

COLUMN 12

Line 15, "pumped out" should read --pumped-out--.

UNITED STATES PATENT AND TRADEMARK OFFICE

CERTIFICATE OF CORRECTION

PATENT NO. : 5,903,802

DATED : May 11, 1999

INVENTOR(S) : AKIRA WATANABE ET AL.

It is certified that error appears in the above-identified patent and that said Letters Patent is hereby corrected as shown below:

COLUMN 13

Line 32, "passage way" should read --passageway--.

COLUMN 15

Line 31, "Example 7" should read --EXAMPLE 7--.

COLUMN 17

Line 3, "coil" should read --oil--;
Line 8, "is" should read --was--;
Line 16, "that is" should be deleted;
Line 44, "coil" should read --oil--; and
Line 56, "($2MgO.2Al_2O_3.5SiO_2$)" should read --($2MgO.2Al_2O_3.5SiO_2$).--.

COLUMN 18

Line 2, "coil" should read --oil--.

COLUMN 19

Line 66, "in the" should be deleted.

COLUMN 20

Line 18, "same" should read --the same--;
Line 44, "particles" should read --particle--; and
Line 60, "absorbing layer 106" should read --retaining layer 196--.

UNITED STATES PATENT AND TRADEMARK OFFICE

CERTIFICATE OF CORRECTION

PATENT NO. : 5,903,802

DATED : May 11, 1999

INVENTOR(S) : AKIRA WATANABE ET AL.

It is certified that error appears in the above-identified patent and that said Letters Patent is hereby corrected as shown below:

COLUMN 21

Line 14, "coil" should read --oil--;
Line 28, "($2MgO.2Al_2O_3.5SiO_2$)" should read --($2MgO.2Al_2O_3.5SiO_2$). ¶ The--;
Line 38, "absorbing layer 106" should read --retaining layer 196--; and
Line 59, "coil" should read --oil--.

COLUMN 22

Line 20, "metals" should read --materials--.

Signed and Sealed this

Eighteenth Day of January, 2000

*Attest:*

*Attesting Officer*

Q. TODD DICKINSON

*Commissioner of Patents and Trademarks*